US008307999B2

(12) United States Patent
Pintur

(10) Patent No.: US 8,307,999 B2
(45) Date of Patent: Nov. 13, 2012

(54) DEVICE FOR PRESENTING EYEGLASSES

(76) Inventor: Mladen Pintur, Biograd (HR)

( * ) Notice: Subject to any disclaimer, the term of this patent is extended or adjusted under 35 U.S.C. 154(b) by 868 days.

(21) Appl. No.: 11/814,771

(22) PCT Filed: Jan. 24, 2006

(86) PCT No.: PCT/IB2006/001171

§ 371 (c)(1),
(2), (4) Date: May 5, 2008

(87) PCT Pub. No.: WO2006/087641

PCT Pub. Date: Aug. 24, 2006

(65) Prior Publication Data

US 2009/0014604 A1 Jan. 15, 2009

(30) Foreign Application Priority Data

Jan. 25, 2005 (DE) ..... 10 2005 003 573

(51) Int. Cl.
*A47F 7/02* (2006.01)

(52) U.S. Cl. ..... 211/85.1; 211/8; 248/902

(58) Field of Classification Search ..... 248/902, 248/309.1, 551, 553; 211/4, 85.1, 85.7, 8, 211/13.1; 206/5, 6

See application file for complete search history.

(56) References Cited

U.S. PATENT DOCUMENTS

| | | | | |
|---|---|---|---|---|
| 3,827,569 | A | 8/1974 | Canning | |
| 4,596,334 | A | 6/1986 | Daulton | |
| 4,805,781 | A * | 2/1989 | Tegel | 211/85.1 |
| 5,139,324 | A * | 8/1992 | West | 351/158 |
| 5,178,283 | A * | 1/1993 | Ennis | 211/4 |
| 6,182,840 | B1 * | 2/2001 | Tegel | 211/85.1 |
| 6,364,124 | B1 * | 4/2002 | Chen | 211/4 |
| 7,270,241 | B2 * | 9/2007 | Nobili | 211/85.1 |
| 7,762,408 | B2 * | 7/2010 | Sargent | 211/85.7 |
| 2004/0200790 | A1 | 10/2004 | Zoueki | |

FOREIGN PATENT DOCUMENTS

| | | | |
|---|---|---|---|
| BE | 1014244 | A3 | 7/2003 |
| DE | 8804010 | U1 | 1/1988 |
| DE | 3783650 | T2 | 5/1993 |
| EP | 1582118 | A1 | 10/2005 |
| FR | 2830732 | A | 4/2003 |
| WO | WO 2005/002403 | A1 | 1/2005 |

OTHER PUBLICATIONS

International Preliminary Report on Patentability, dated Jul. 31, 2007, which includes the Written Opinion of the ISA dated Jul. 31, 2007.

International Search Report, dated Aug. 24, 2006.

* cited by examiner

*Primary Examiner* — Tan Le

(74) *Attorney, Agent, or Firm* — Henry B. Ward, III; Moore & Van Allen PLLC

(57) ABSTRACT

A device is provided for presenting eyeglasses, comprising a base body and comprising a plurality of accommodating devices carried by the base body and serving for accommodating a respective pair of eyeglasses in secured fashion, wherein each accommodating device comprises at least one supporting part for placing the eyeglasses thereon and a securing part for securing the mounted eyeglasses against removal, and wherein the securing parts can be brought jointly from a locking position, which secures the eyeglasses, into a removal position, which releases the eyeglasses.

39 Claims, 7 Drawing Sheets

DEVICE FOR PRESENTING EYEGLASSES

SUMMARY

Figure 1B:
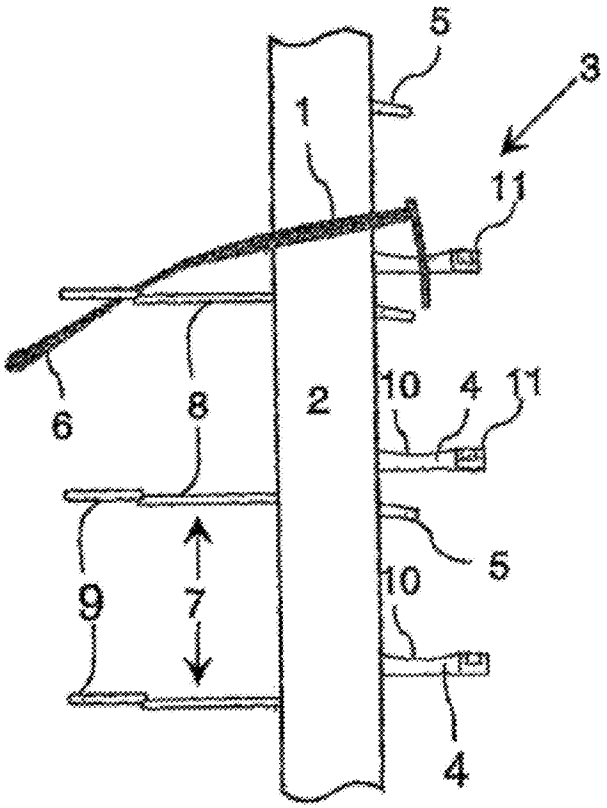

Devices of the generic type have been known for some time from the prior art. Such devices are often referred to as displays and serve for presenting eyeglasses for correcting poor eyesight, on the one hand, and sunglasses of any type, on the other hand. This primarily involves offering the eyeglasses for sale and presenting them for this purpose in their form in a suitable manner. Furthermore, it must be ensured that in particular high-quality and at the same time expensive eyeglasses are not stolen.

The device known from the prior art already comprises the features mentioned above, wherein, for the purpose of equipping the device and for the purpose of removing one or more pairs of eyeglasses, the securing parts are raised slightly relative to the supporting parts, such that the eyeglasses can be removed or mounted via the interspace that arises. On account of the only small distance between the securing part and the supporting part, handling the eyeglasses is awkward and involved and there is always the risk of the eyeglasses being damaged or scratched in the course of being mounted and in the course of being removed. In this respect, the device known from the prior art has proved to be problematic.

In light of the above explanations, the invention is based on the object, then, of configuring and developing the device of the generic type that is known from the prior art in such a way that convenient and at the same time secure handling of the eyeglasses is possible in conjunction with a simple construction.

The device according to the invention achieves the above object by means of the features of patent claim 1. Accordingly, the device mentioned in the introduction is characterized in that the securing parts can be pivoted away from the supporting part from the locking position into the removal position.

It has been recognized according to the invention that the problem in the case of the device of the generic type is primarily attributable to the fact that the securing parts impede the handling of the eyeglasses, even if the securing parts are in the opened removal position. It has furthermore been recognized that this is attributable to the fact that when a securing part has been lifted up slightly from the accommodating part, the space provided for handling the eyeglasses is not sufficient, namely because the securing part still rests directly in the region of the supporting part. It is not possible for the securing part to be moved further away from the supporting part owing to geometrical and technical-constructional circumstances.

It has thus been recognized in a manner further according to the invention that the securing part can be ideally moved away from the region of the supporting part—on the one hand for occupying the supporting part with a pair of eyeglasses and on the other hand for removing the eyeglasses—namely by the securing part being configured in pivotable fashion, such that it can namely be pivoted away from the supporting part from the closed locking position into the opened removal position and therefore releases virtually the entire region around the supporting part and around the supporting part. When the securing part has been pivoted away virtually altogether, the eyeglasses lie freely on the supporting part and can be removed manually. Likewise, the supporting part can be occupied with a pair of eyeglasses in an unimpeded manner, without the securing part being a disturbance in the process.

With regard to a particularly simple construction of the device according to the invention, it is advantageous if the supporting parts can be inserted into the base part and be locked there preferably at predetermined locations. It is thus possible, in principle, for a preferably vertically extending groove to be provided for accommodating the supporting parts, into which groove the supporting parts can be inserted and fixed there for example by clamping action. It is likewise conceivable for concrete insertion openings to be provided in the base part, into which insertion openings the supporting parts can be inserted equidistantly or at different distances with respect to one another and can be fixed there. It is also conceivable for the supporting parts to be screwed into the base part.

In principle, the supporting parts project essentially orthogonally from the base body, wherein the supporting parts can also be arranged at a predetermined angle on the base part, depending on the desired visual impression that is intended to be conveyed when the eyeglasses are displayed. It is furthermore advantageous for the supporting parts to be configured in filigree fashion, and for this purpose said supporting parts can be embodied in rod or bar form, such that the main attention is directed at the eyeglasses mounted there, rather than for instance at the supporting part.

In order to avoid damage to the eyeglasses, it is furthermore advantageous if the supporting parts are coated with plastic or are covered with a sleeve material, preferably composed of plastic. In the context of a configuration composed of aluminum, a transparent sleeve could be drawn over the supporting part. The use of supporting parts having a circular cross section is appropriate in this case.

It is furthermore conceivable for the supporting parts to have a preferably downwardly curved supporting region for supporting the nosepiece of the eyeglass. For securely positioning the nosepiece, the supporting region could be embodied in undulatory fashion, but could also comprise steps, flutings or the like, such that the eyeglasses can be positioned according to their size at any desired locations of the supporting part in a non-slip manner. It is also conceivable that slides or the like can be arranged on the supporting part in displaceable or insertable fashion, such that the respective eyeglasses are afforded a secure and at the same time adjustable bearing.

For securely closing the device by means of the securing part, the supporting parts have a preferably end-side stop region for forming a stop for the free end of the securing part. Thus, the securing part could come to bear against the supporting part in a lockable manner, namely in the closed locking position. It is likewise conceivable for a cutout, depression or the like corresponding to the free end of the securing part to be assigned in the supporting part, such that the securing part can engage by its free end into the supporting part. Lateral bending out of the securing part is effectively avoided in the closed position in this case.

In order that the eyeglasses with bows folded out can be positioned for examination on all sides, a bow holder is arranged on that side of the base body which is remote from the supporting parts and securing parts, i.e. on the rear side as seen from the observer, for each pair of eyeglasses, such that the eyeglasses bear with their nosepiece on the supporting part and with the side bows on the bow holder. A type of three-point support is realized in this case.

The bow holder can also be fixable at different locations of the base part, preferably slightly below the supporting part, thus resulting in an at least slightly oblique positioning of the eyeglasses in a particularly decorative manner. For this purpose, the bow holder can have an engagement region for insertion into the base body, which is adjoined by a rod projecting from the base body and serving for spacing apart relative to the base body. For actually supporting the bows of the eyeglasses, straps are provided which project on both sides from the rod toward the side and serve for placing the bows of the eyeglasses thereon, which are further advantageously bent away toward the rear with a large radius. This results in an especially decorative effect, on the one hand, and in a secure support for the bows of the eyeglasses, on the other hand. In order to avoid damage or scratches in the region of the bow of the eyeglasses, the bow holder is coated with plastic or covered with a sleeve, preferably composed of plastic, referred to generally as reference numeral 34 in the Figures, at least in the region of the projecting straps. A transparent sleeve may be involved in this case, such that the material-governed visual impression is not distorted. The use of plastic has the advantage, moreover, that a non-slip support is afforded for the bows of the eyeglasses.

The securing part has already been discussed previously, whereby an anti-theft protection or an unauthorized removal of the eyeglasses is effectively prevented. In concrete terms, the securing part can be embodied and shaped in such a way that it projects orthogonally from the base body—preferably out of the latter—in the closed locking position and extends toward the supporting part in the region of the front free end. For this purpose, the securing part can be embodied in hooked fashion, preferably in a manner angled by 90°. In the case of such a configuration, the securing part reaches around a pair of eyeglasses, mounted on the supporting part, in the region of the nosepiece, preferably at a distance, such that in this case, too, damage to the eyeglasses is effectively avoided even though the securing part reaches around the eyeglasses at only a small distance. The distance should be dimensioned precisely so as to preclude unauthorized removal of the eyeglasses when the securing part is closed. It has already been explained above that the device according to the invention differs from the device of the generic type from the practically known prior art in that the securing part can be pivoted away virtually completely, such that the eyeglasses bear freely on the supporting part and with their bows on the bow holder. A complete or at least virtually complete pivoting away of the securing part is possible when the securing part can essentially be pivoted into the base body, which is possible in particular when the securing part pivots about a pivot axis lying within the base body. In this case, along the base part, that is to say preferably vertically, a slotlike opening could extend into the base part, said opening being designed in such a way that the securing part can be pivoted into the base part altogether or virtually altogether.

In principle, it is conceivable that the securing parts can be actuated manually, preferably jointly follow a type of towing device. In order to actuate the securing parts, a particular actuating element is advantageously provided, through the activation of which actuating element the securing parts can be pivoted jointly. In concrete terms, the base body could be embodied in the sense of a column or slab, wherein the actuating element can be moved or displaced within the base body relative to the base body or to a particular anchoring part.

In this case, it is appropriate for the actuating element to be arranged as an actuating rod arranged such that it can be displaced within the base body. The anchoring part can correspondingly be embodied as an anchoring rod arranged in stationary fashion within the base body or as a component part of the base body or of the housing formed by the base body. In concrete terms, the housing can be a profile composed of aluminum.

The pivoting movement of the securing part can be realized in a particularly refined manner by virtue of the fact that the securing part comprises two articulation locations by means of which the securing part is articulated in a pivotable manner on the one hand on the actuating element or on the actuating rod and on the other hand on the anchoring part or on the housing or profile, wherein this articulation must permit an offset. It is thus conceivable for the securing part to comprise two pivoting pins which preferably project orthogonally in pairs and which engage into pivoting guides formed in pairs in the anchoring part and in the actuating element. For the offset between the two parts, the pivoting guides are embodied as guide slots or guide cutouts, guide grooves or the like, such that the pivoting pins assigned to the securing part can be moved at least slightly in the actuating element or in the actuating rod and in the anchoring rod or in the wall of the base body. Moreover, it is possible, in principle, that in the event of a movement of the actuating element or the actuating rod, the latter not only moves vertically and relative to the anchoring part in the vertical direction, rather the actuating element like a rocker moves away from the anchoring part or from the anchoring rod and moves toward it again, such that a two-dimensional rocking movement of the actuating element takes place during the opening and closing of the securing parts. With suitable guidance of the actuating element, such a movement can be realized effortlessly within the base part.

In order then to hold the actuating element relative to the anchoring part and to realize a simple guidance, it is furthermore advantageous if the guide slots or guide cutouts or guide grooves of adjacent securing parts are formed on opposite sides of the anchoring part and of the actuating element, such that a linking of the actuating element to the anchoring part is realized thereby. The extent to which the actuating element moves away from the anchoring part is therefore prescribed by the spacing apart of the pivoting pins on the securing part and by the precise embodiment of the guide slots or guide cutouts in the actuating element and in the anchoring part.

It has already been explained above that the actuating element serves for simultaneously actuating all the securing parts. In accordance with the above explanations, there is an operative connection between the actuating element and the securing parts, such that a pivoting movement of the securing parts on account of an action of the actuating element is possible.

In the context of an especially simple embodiment of the device according to the invention, the actuating element operates at least partially on account of the force of gravity, namely to the effect that the actuating element falls into the opened removal position of the securing parts on account of the force of gravity. Correspondingly, the actuating element can be raised into the closed securing position of the securing parts and can be fixed and locked in both positions. For the actuation of the actuating element, an actuating lever, a knob or the like could be provided, such that the actuating element can be raised into the closed securing position from outside the base part, whereby all the securing straps close. In this case, it is especially advantageous if the movement of the actuating element and hence the movement of the securing parts is elastically damped, such that a temporally delayed opening of the securing parts takes place in the event of unlocking. The damping could be realized in a manner similar to how this is the case in modern motor vehicles, in the handles thereof, according to which namely a spring damping, a pneumatic damping or a damping by means of silicone or the like is realized.

It is advantageous in any case if the actuating element, by means of spring force, pneumatically or the like, preferably in damped movement, can be lowered into the opened removal position of the securing parts and can be raised into the closed securing position of the securing parts and can be fixed and locked in both positions. It goes without saying that this is also possible the other way round, according to which the securing parts are closed in the lowered state of the actuating element.

In the context of a further configuration variant, the actuating element, by means of an electric motor, preferably in damped movement, can be lowered into the opened removal position of the securing parts and can be raised into the closed securing position of the securing parts. An opposite arrangement or an opposite securing and releasing operation is conceivable in this case as well. The actuating element and hence the securing parts can be fixed and locked in both positions.

The drive for the actuating element, thus the electric motor, for example, could be arranged in or on the base body. In the context of an especially advantageous configuration, the motor is dimensioned in such a way that it just fits into the base body, preferably in the upper region, such that it can be modularly inserted and also removed again. A simple exchange of the drive is ensured in this case. It is likewise possible for the motor to be plugged onto the base body.

Furthermore, it is advantageous if the drive has an internal power supply, preferably a rechargeable battery. It is likewise conceivable for an external connection to the electricity supply system to be possible. The charging of a rechargeable battery by means of solar cells is likewise conceivable, a photovoltaic coating of regions of the base body being conceivable. It is essential in any case that an electrical actuation of the actuating element is possible, in principle, thus resulting in the possibility of remote control by means of a miniaturized manual switch.

As already explained previously, the securing parts can be locked and in this case can preferably be closed off in the locking position, such that an unauthorized opening of the securing parts is not possible. A relative movement between the anchoring part and the actuating element is prevented for the purpose of closing off the securing parts, such that the securing parts coupled to both parts are immobile and therefore cannot be opened. A locking bolt can be provided for the purpose of closing off the securing parts, said locking bolt acting on or in the actuating element from outside the base part, or acting between the actuating element and the anchoring part or the base part.

In the context of an effective safeguarding and in the context of a simple configuration it is conceivable for the locking bolt to be a component part of a mechanical or electrical or electromagnetic lock. In this respect, too, an automatic actuation of the locking device is conceivable, in particular also by means of remote control.

It should be noted at this point that the locking bolt can be formed at any desired locations of the base part, especially as it can act on the actuating element in a blocking manner from all points. In an advantageous manner, the locking bolt is arranged in the foot region in or at the base body, wherein this should be geared to whether the device is a standing part or a wall-mounted part or table part. Thus, the locking bolt is preferably and advantageously provided, in accordance with the concrete fitting of the device, where it can be operated effortlessly. In the case of a remote control, however, this is of secondary importance at most.

As already mentioned previously, the drive for the actuating element and/or the locking bolt or the lock can be actuable remotely. For this purpose, a remote actuation could take place by means of RF signals with corresponding transmitters/receivers, as is known from a wide variety of applications. An RF remote control has the huge advantage over a remote control operating in the infrared region that it has a greater range and that it can also avoid obstacles. An RF remote control is advantageous in this respect in any case.

In a particularly refined manner, the position of the actuating element can be detected, wherein the base body can be assigned a preferably battery-operated or battery-buffered acoustic and/or optical indication which indicates the locking position or the removal position of the securing parts depending on the position of the actuating element. Thus, by way of example, the closed position can be visualized by means of an optical indication, while a sound or a sound sequence can be emitted in the opened state, for example when the device remains in the opened state over a definable relatively long period of time. This effectively prevents the device from inadvertently being left in the opened state and thus enabling the eyeglasses to be stolen.

It is likewise conceivable that the position of the actuating element can be detected, and that the base body is assigned a preferably battery-operated or battery-buffered alarm system which can be triggered depending on the position of the actuating element taking account of the locked state. Thus, an alarm could be triggered in the event of violent opening, such that an extensive protection is also ensured in this respect. It is likewise conceivable for the individual securing parts to be assigned a particular detector which detects a weight resting thereon. Upon removal of the eyeglasses, the securing part would move upward at least slightly, whereby the detector registers a removal of the eyeglasses. This, too, could be coupled to an acoustic and/or light-optical signal, such that an extensive safeguarding is realized.

It should furthermore be noted that the base body can be embodied for being placed onto the floor or onto a table with a foot part. The base body can likewise be provided with corresponding mounts for being suspended from the ceiling or on a wall.

It is furthermore conceivable for the base part to be assigned a preferably internal light source, referred to generally as reference numeral 24 in the Figures, with at least one light outlet, referred to generally as reference numeral 26 in the Figures, wherein the light outlet can readily also be assigned to the securing part or the supporting part. The use of optical fibers, referred to generally as reference numeral 28 in the Figures, with a defined light exit is conceivable, whereby very particular effects can be produced. The use of Plexiglas with a light exit in the edge region is also advantageous.

The device according to the invention has been described with a singular base part above. It is likewise possible for a plurality of the base parts to be arranged vertically and at the same time parallel to one another on a common receptacle. Such a parallel arrangement is also conceivable on a wall with corresponding mounts, such that an entire battery of corresponding base parts in identical configuration can be realized alongside one another and parallel to one another. A plurality of the base parts could also be arranged around a central column on a cabinet pedestal or the like. It is also possible to realize an arrangement of a plurality of base parts in the manner of a turret arrangement on a rotatable basis. Any desired arrangements of individual base parts in a fixed relation with respect to one another are conceivable, to be precise irrespective of the concrete positioning and determination.

BREIF DESCRIPTION OF THE SEVERAL VIEWS OF THE DRAWINGS

Figure 6A:
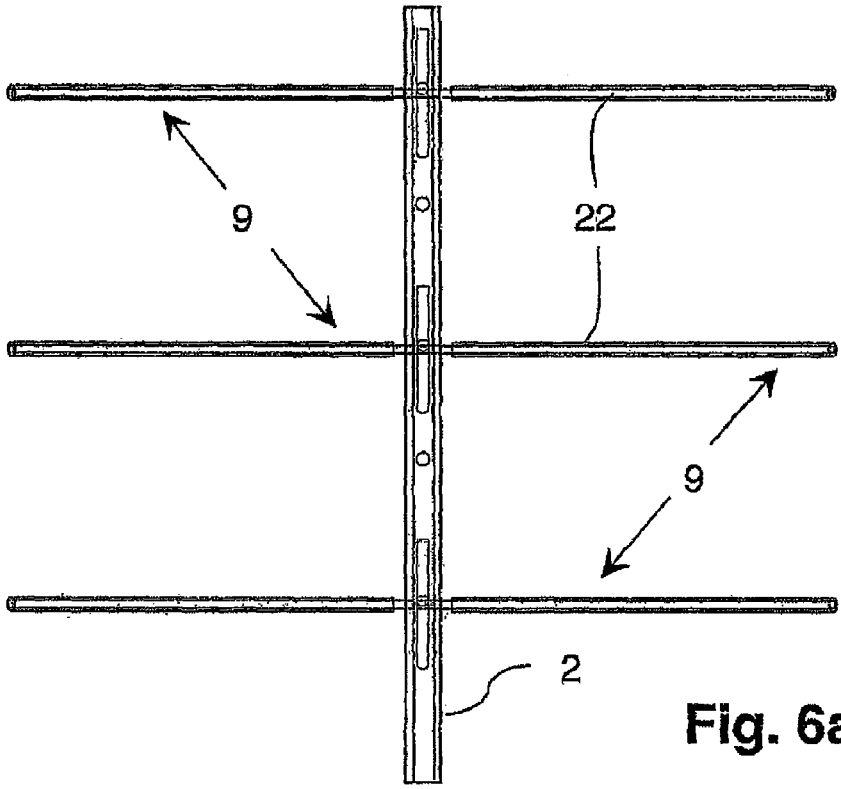
Figure 6A:
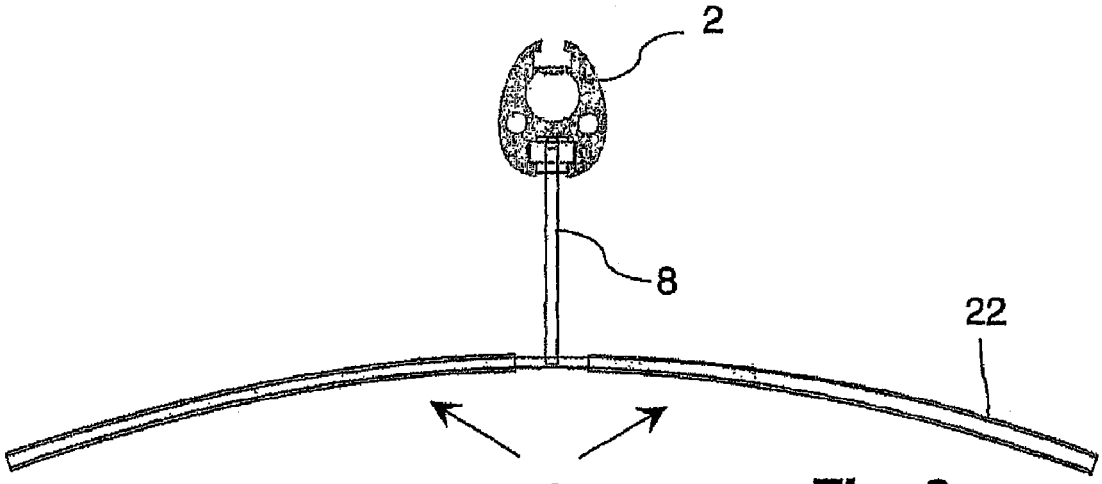
Figure 7:
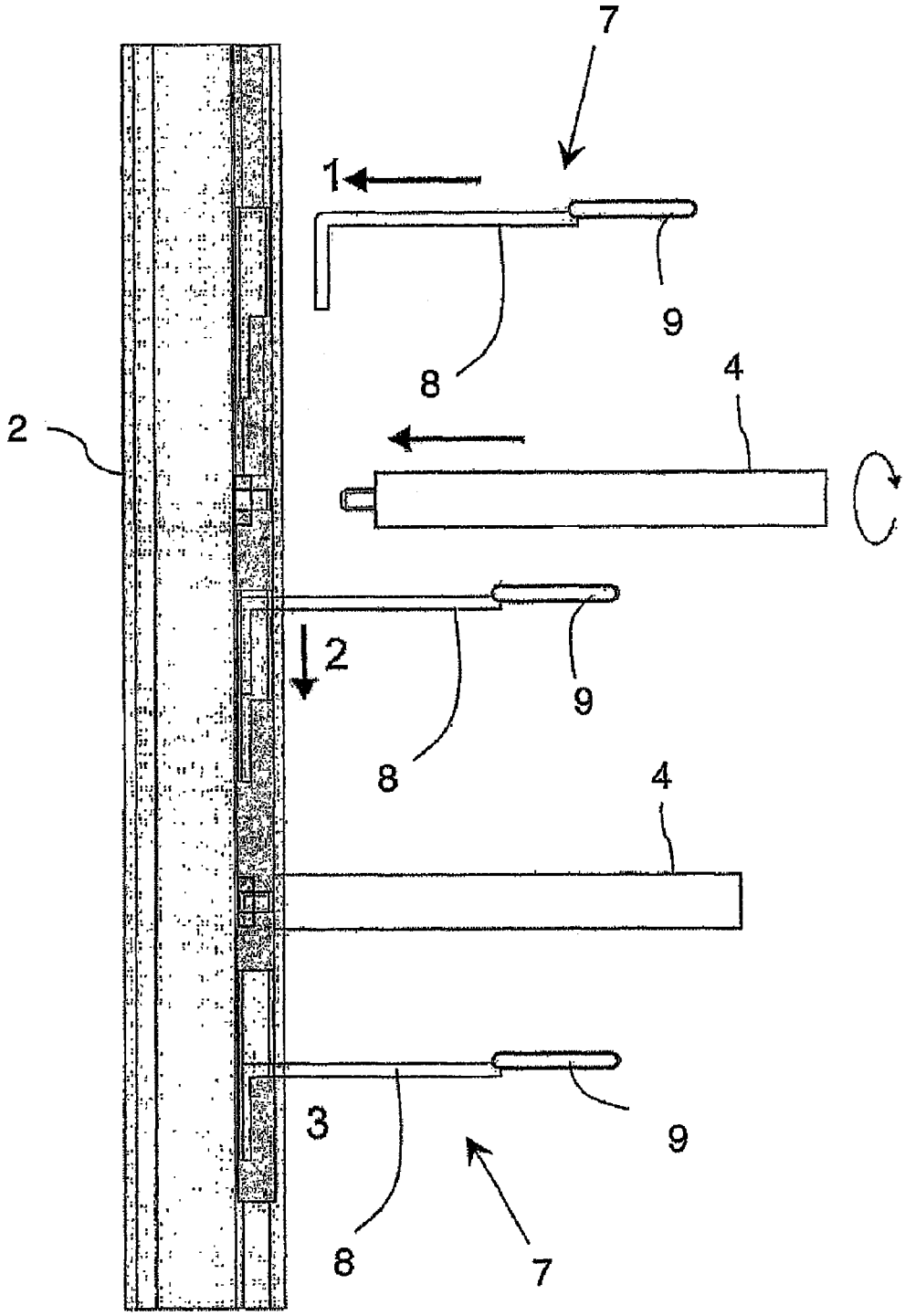

There are, then, various possibilities for configuring and developing the teaching of the current invention in an advantageous manner. In this respect, reference should be made on the one hand to the patent claims which are subordinate to patent claim 1, and on the other to the following explanation of exemplary embodiments of the invention with reference to the drawing. Generally preferred configurations and developments of the teaching are also explained in conjunction with the explanation of the preferred exemplary embodiments of the invention with reference to the drawing. In the drawing, FIGS. 1*a, b* show in a schematic side view, partly, an exemplary embodiment of a device according to the invention with mounted eyeglasses in the closed and opened state, FIGS. 2*a, b* show, in a perspective view, the device from FIG. 1 in the closed and opened state, FIGS. 3*a, b, c* show a first concrete exemplary embodiment of a device according to the invention in the closed, partly opened and altogether opened state, the actuating element opening by means of the force of gravity, FIGS. 4*a, b, c* show a second concrete exemplary embodiment of a device according to the invention in the closed, partly opened and altogether opened state, the actuating element opening and closing when acted upon by means of spring force, FIGS. 5*a, b, c* show a third concrete exemplary embodiment of a device according to the invention in the closed, partly opened and altogether opened state, the actuating element opening and closing in a manner actuated by means of an electric motor, FIG. 6*a* shows, in a schematic rear view, a device according to the invention with bow holders inserted therein, and FIG. 6*b* shows, in a schematic plan view, a section through the base body and of the bow holder, and FIG. 7 shows, in a schematic view, the sequence of inserting the bow holder, on the one hand, and the supporting part, on the other hand, depicted from one side for the sake of simplicity.

DETAILED DESCRIPTION OF THE INVENTION

Figure 1A:
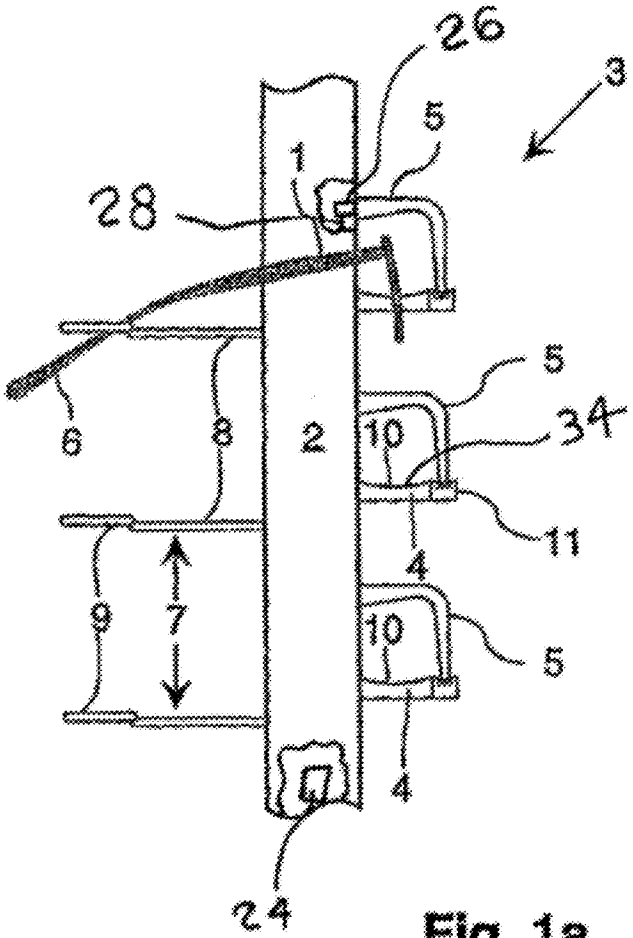
Figure 2B:
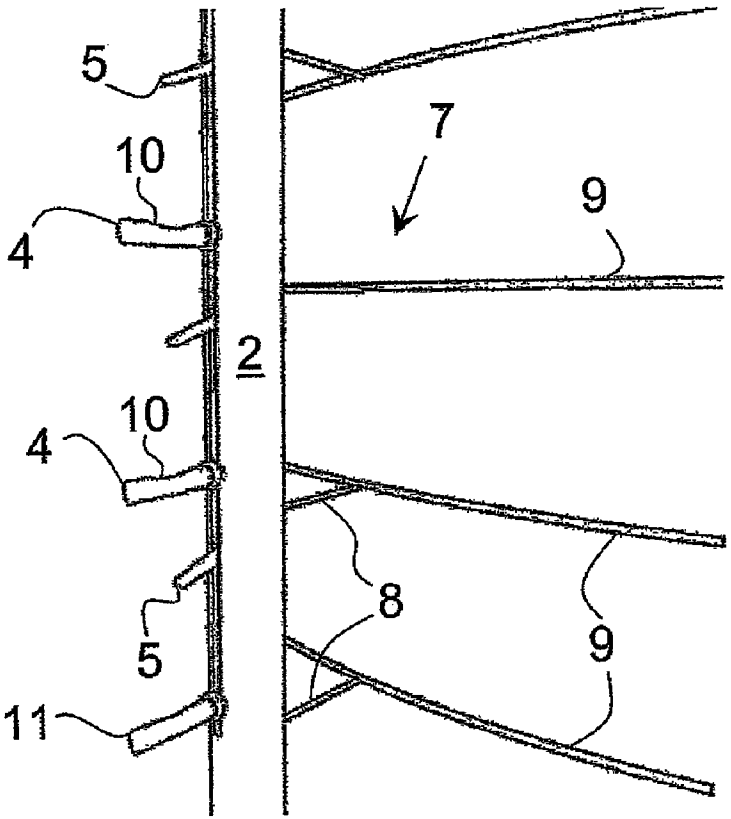
Figure 2A:
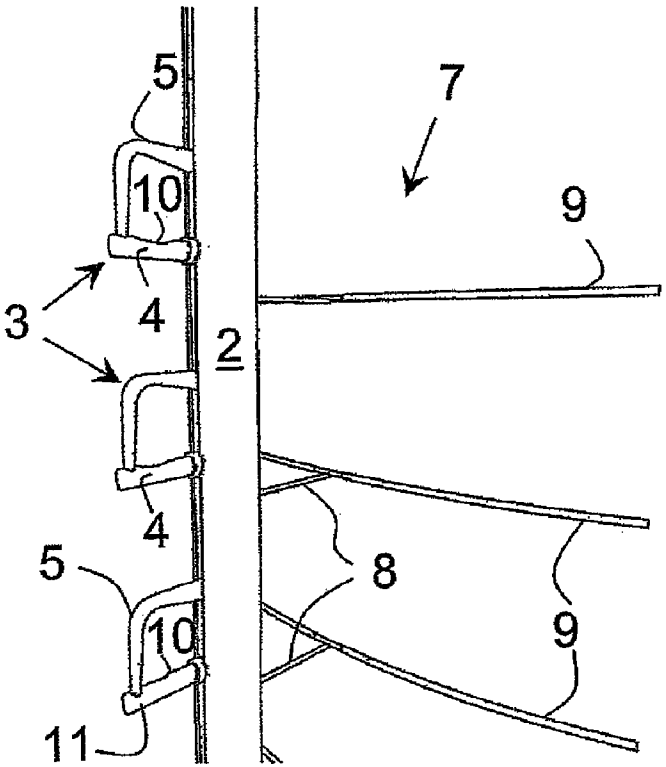

The sequence of FIGS. 1 and 2 shows, in schematic views, partly, the basic construction of a device according to the invention for presenting eyeglasses 1, wherein the device comprises a base body 2 and accommodating devices 3 carried by the base body 2 and serving for accommodating a respective pair of eyeglasses 1 in a secured manner. Each accommodating device 3 in turn has a supporting part 4 for mounting the eyeglasses 1 thereon and a securing part 5 for securing the mounted eyeglasses 1 against removal. The securing parts 5 can be brought jointly from a locking position, which secures the eyeglasses 1, in accordance with FIGS. 1*a* and 2*a* into a removal position, which releases the eyeglasses 1, in accordance with FIGS. 1*b* and 2*b*.

According to the invention, the securing parts 5 can be pivoted away from the supporting part 4 from the locking position in accordance with FIGS. 1*a* and 2*a* into the removal position in accordance with FIGS. 1*b* and 2*b*, which can be inferred from the sequence of the movement progression that can be inferred from FIGS. 1 and 2.

FIGS. 3*a*, 3*b* and 3*c*, 4*a*, 4*b* and 4*c*, and 5*a*, 5*b* and 5*c* show in the context of concrete exemplary embodiments in detail how the pivoting movement of the securing parts 5 with regard to the fixed supporting part 4 is realized.

FIGS. 1 and 2 furthermore reveal that bow holders 7 are provided for mounting the bows 6 of the eyeglasses thereon, said bow holders being arranged in the base body 2 on the opposite side of the base body 2 to the supporting part 4 and the securing part 5. The bow holders 7 project away from the base body 2 with a rod 8 and extend via straps 9 to the side, such that the eyeglasses 1 come to bear with the bows 6 of said eyeglasses there, as can be inferred from FIG. 1.

FIGS. 1 and 2 furthermore together reveal that the securing part 5 can be pivoted virtually altogether into the interior of the base body 2, such that unimpeded access to the eyeglasses 1 is possible when the securing part 5 has been opened.

FIGS. 1 and 2 furthermore indicate that the supporting part 4 has a curved supporting region 10 and an end-side stop region 11 for the engagement of the free end of the securing part 5.

Furthermore, FIGS. 2*a* and 2*b* indicate that the straps 9 of the bow holder 7 are covered with plastic, namely in order to protect the eyeglasses 1 and to ensure a secure retention for the latter.

Figure 3C:
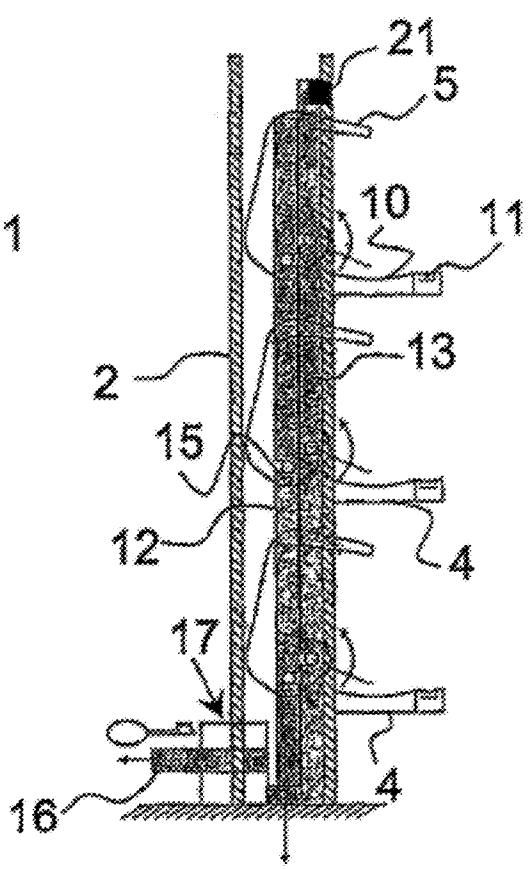
Figure 3B:
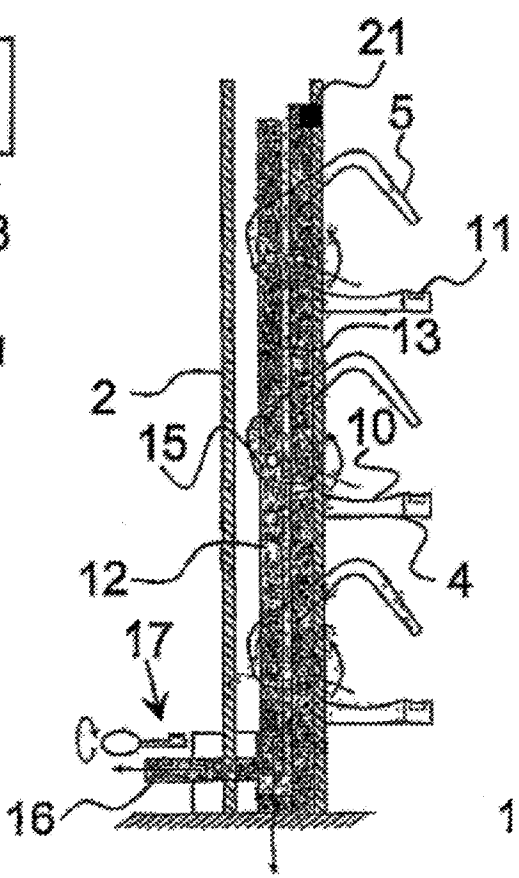
Figure 3A:
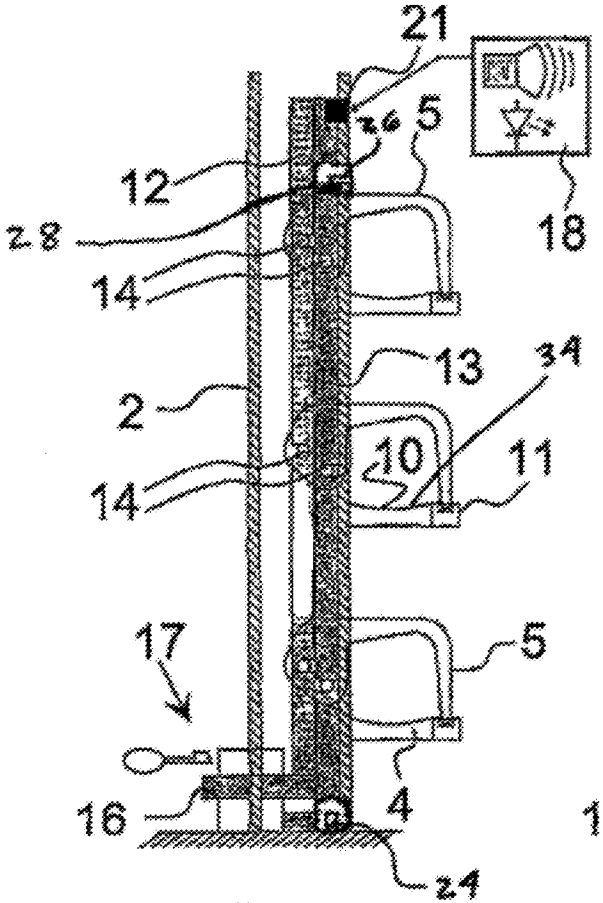

In the exemplary embodiment shown in FIGS. 3*a*, 3*b* and 3*c*, it can be discerned that the pivot axis of the securing part 5 lies within the base body 2. For actuating the securing parts 5, an actuating element 12 is provided, which can be displaced within the base body 2 relative to an anchoring part 13, which is in turn fixedly assigned to the base body 2. The actuating element 12 is embodied as an actuating rod. The anchoring part 13 is correspondingly embodied as a stationary anchoring rod, wherein the anchoring part 13 can readily also be embodied as an integral component part of the base body 2 or of the housing formed by the base body 2 or of the corresponding profile.

FIGS. 3*a*, 3*b* and 3*c* furthermore reveal that the securing part 5 comprises two pivoting pins 14 which project orthogonally in pairs and which engage in pivoting guides 15 formed in pairs in the anchoring part 13 and in the actuating element 12. By virtue of this arrangement and configuration, the securing parts 5 can be pivoted simultaneously, namely in response to a movement of the actuating element 12, the actuating element 12 being moved parallel to the anchoring part 13 and hence also parallel to the base body 2—in the base body 2.

FIGS. 3*a*, 3*b* and 3*c* furthermore reveal that the securing parts 5 can be locked in the closed state, namely by means of a locking bolt 16, which holds the actuating element 12 in the raised state when the securing parts 5 are locked. The locking bolt 16 is assigned to a mechanical lock 17. If the locking bolt 16 is released by means of the lock 17, the actuating element 12 can move downward by means of the force of gravity, as is illustrated in FIG. 3*b* through to FIG. 3*c*. In the totally lowered state of the actuating element 12, the securing parts 5 are completely pivoted into the opened state and swung away in the process, such that the supporting part 4 is exposed in an unimpeded manner.

FIGS. 3*a*, 3*b* and 3*c* furthermore indicate that the device is equipped with an alarm system 18, which triggers an acoustic and/or optical alarm in the event of unauthorized opening of the securing parts 5.

Figure 4C:
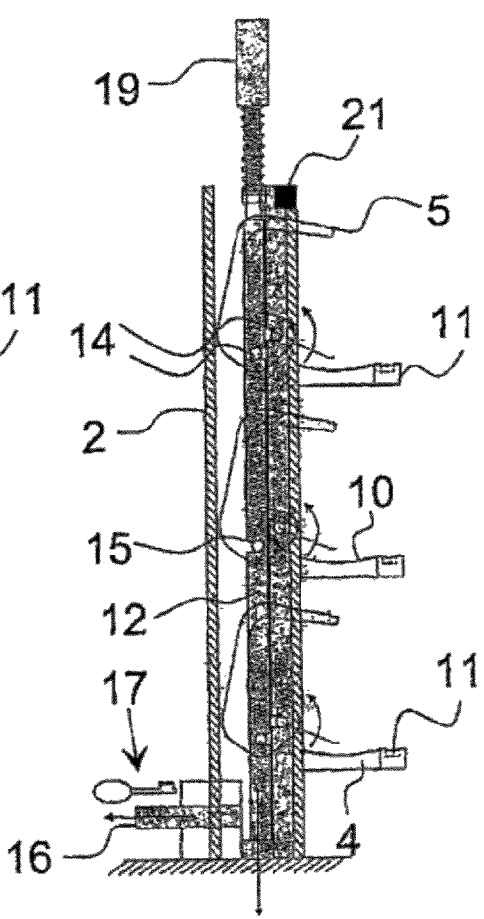
Figure 4B:
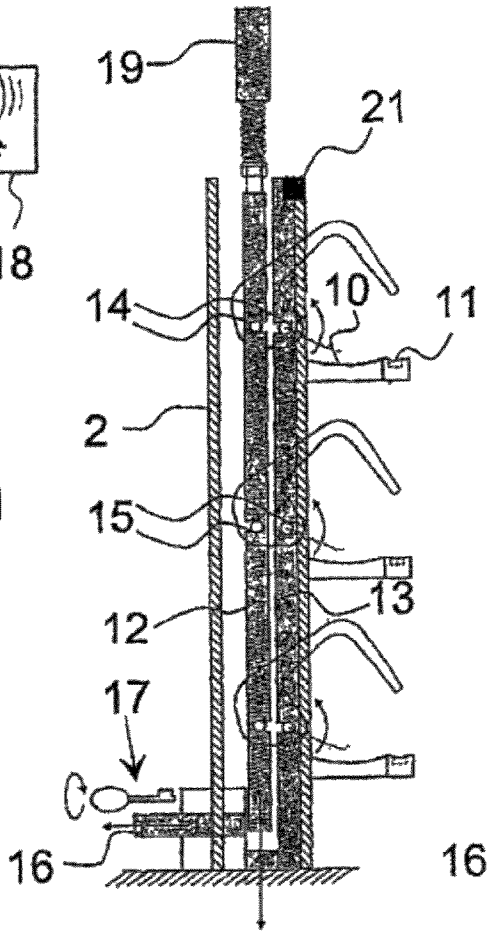
Figure 4A:
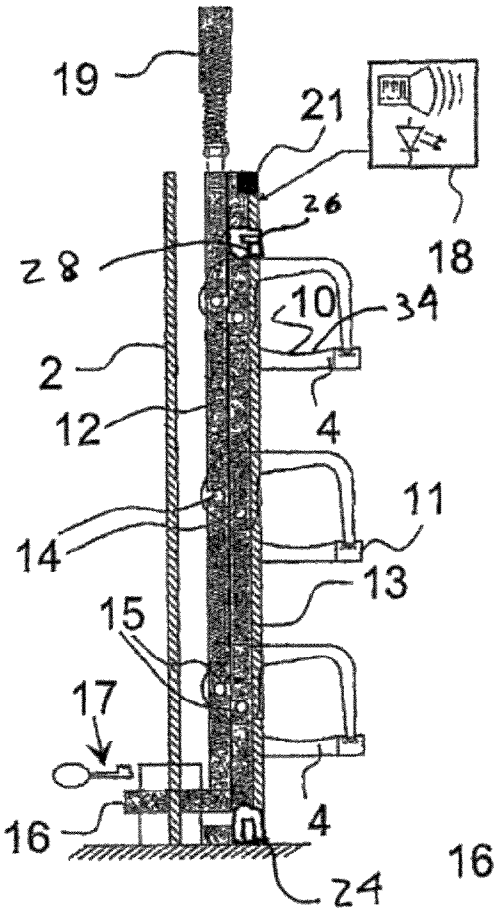

FIGS. 4*a*, 4*b* and 4*c* show a second exemplary embodiment of a device according to the invention, in which the actuating element 12 can be actuated by means of spring force. This is illustrated symbolically by means of the spring arrangement 19. In this case, too, the securing parts 5 are in the closed state if the actuating element 12 is raised and secured by means of the lock 17 or the locking bolt 16. After unlocking by means of the lock 17, the actuating element 12 slides upward with rocking movement, namely is pulled upward by the spring arrangement 19 until, in accordance with FIG. 4*c*, the securing parts 5 have been completely opened. The securing parts 5 are moved in damped fashion, that is to say in temporally delayed fashion.

Figure 5C:
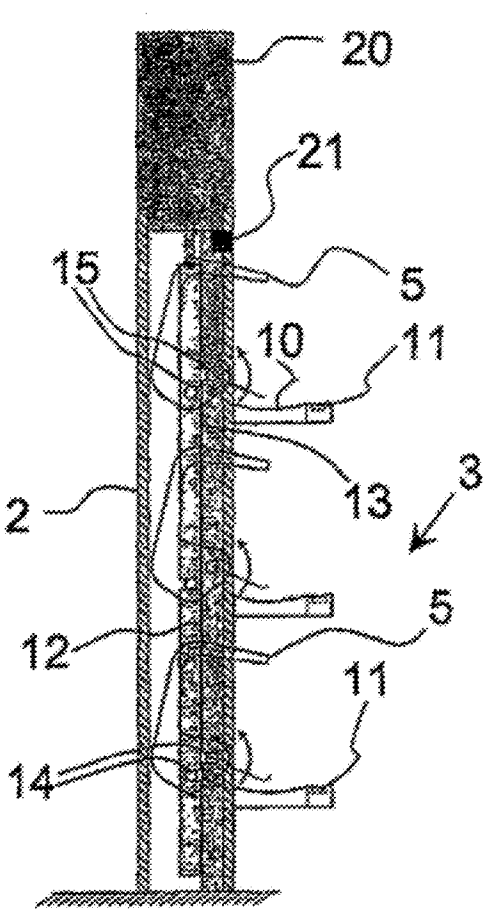
Figure 5B:
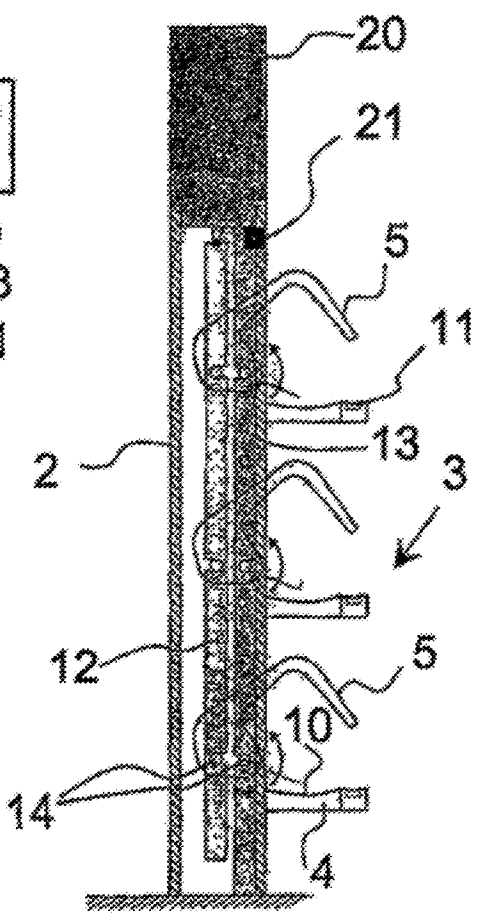
Figure 5A:
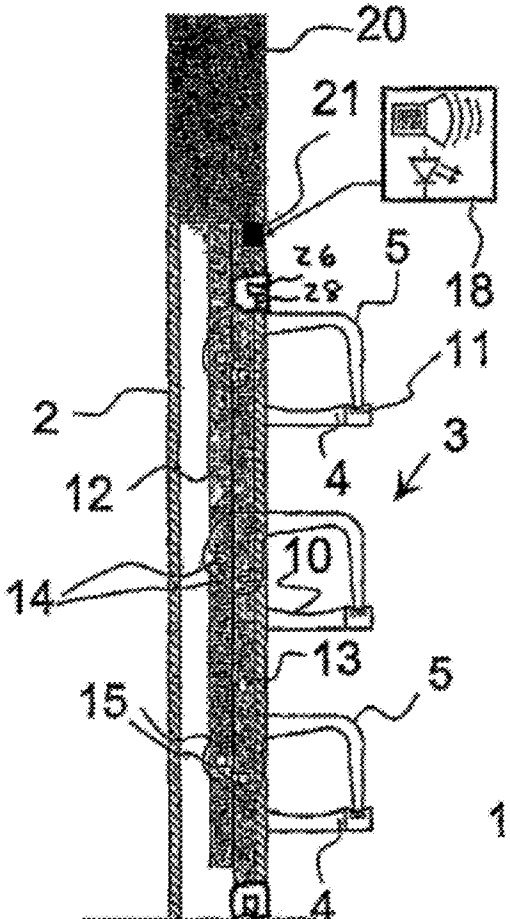

FIGS. 5*a*, 5*b* and 5*c* show a third exemplary embodiment of a device according to the invention, wherein the actuating element 12 is actuated by means of an electric motor 20. A particular locking is no longer necessary in this case since the actuating element 12 is held altogether by means of the motor 20 and is locked in the respective position. Such an arrangement is ideal for realizing a remote control, as explained in the general part of the description.

With regard to the electric motor 20, it should be noted that said electric motor is coordinated exactly with the base body 2, such that it lengthens said base body toward the top. In this case, too, an alarm system 18 can be provided, which can be actuated by means of a sensor arrangement 21.

FIGS. 6*a* and 6*b* show the device according to the invention with regard to the bow holder 7 with the rod 8 and the projecting straps 9, wherein the bow holder 7 can be fixed to the base body 2. The figures indicate, moreover, that the bow holder 7 is covered with a protective sleeve 22.

Finally, FIG. 7 shows, in a schematic view, the base body 2, into which the supporting part 4 can be screwed and the bow holder 7 can be inserted or pushed. For the sake of simplicity, the two components are illustrated on the same side, even though they are arranged opposite one another, as can be inferred from the figures discussed above.

Finally, it should be pointed out that the exemplary embodiments discussed above explain the claimed teaching, but do not restrict said teaching to the exemplary embodiments.

What is claimed is:

1. A device for presenting eyeglasses, each pair of eyeglasses comprising a nosepiece and two bows, the device comprising:

a base body; and a plurality of accommodating devices carried by said base body, wherein each of said accommodating devices is configured to accommodate a pair of eyeglasses in secured fashion and comprises:

a supporting part structured to receive at least a portion of the pair of eyeglasses, wherein said supporting part comprises a free end;

a securing part for securing the pair of eyeglasses against removal, wherein said securing part comprises a first end and a second end;

an actuating element connected to said securing part and configured to pivot said securing part; and wherein said securing part pivots about said first end via the actuating element from a locking position, engaging at least a portion of said supporting part, which secures the pair of eyeglasses, into a removal position, which releases the pair of eyeglasses; and wherein said securing parts of each of the plurality of accommodating devices are pivoted jointly by movement of respective ones of said actuating elements such that said securing parts of each of the plurality of accommodating devices are brought jointly from the locking position into the removal position, and wherein the securing parts of each of the plurality of accommodating devices are essentially pivoted into the base body.

2. The device as claimed in claim 1, wherein said supporting part is configured to be inserted into said base body at a predetermined location.

3. The device as claimed in claim 1, wherein said supporting part projects orthogonally from said base body.

4. The device as claimed in claim 1, wherein said supporting part comprises a rod or bar.

5. The device as claimed in claim 1, wherein said supporting part is coated with plastic or is covered with a sleeve material composed of plastic.

6. The device as claimed in claim 1, wherein said supporting part has a downwardly curved supporting region for supporting the nosepiece of the pair of eyeglasses.

7. The device as claimed in claim 6, wherein said supporting region comprises steps or flutings for securely positioning the nosepiece.

8. The device as claimed in claim 1, wherein said supporting part has a stop region for engaging said second end of said securing part.

9. The device as claimed in claim 1, wherein each of said accommodating devices comprises a bow holder, wherein said bow holder is arranged on one side of said base body which is remote from said supporting part and said securing part.

10. The device as claimed in claim 9, wherein said bow holder comprises an engagement region for insertion into said base body, a rod projecting from said base body, and at least one strap projecting from said rod for supporting the bows of the pair of eyeglasses.

11. The device as claimed in claim 10, wherein said at least one strap is coated with plastic or covered with a sleeve composed of plastic.

12. The device as claimed in claim 1, wherein said securing part, in the locking position, projects orthogonally from said base body and extends toward said free end of said supporting part.

13. The device as claimed in claim 12, wherein said securing part is embodied in hooked fashion, in a manner angled by approximately 90°.

14. The device as claimed in claim 1, wherein said securing part is configured to be pivoted about a pivot axis contained within said base body.

15. The device as claimed in claim 1, wherein said base body comprises an anchoring part, and said actuating element is configured to be moved or displaced relative to said anchoring part.

16. The device as claimed in claim 15, wherein said actuating element comprises an actuating rod configured to be displaced within said base body.

17. The device as claimed in claim 15, wherein said anchoring part comprises an anchoring rod arranged in stationary fashion within said base body.

18. The device as claimed in claim 15, wherein said anchoring part is formed integrally with said base body.

19. The device as claimed in claim 15, wherein said securing part comprises first and second pivoting pins which project orthogonally from said base body, and wherein said anchoring part comprises a first pivoting guide and said actuating element comprises a second pivoting guide, wherein said first pivoting pin engages said first pivoting guide and said second pivoting pin engages said second pivoting guide.

20. The device as claimed in claim 19, wherein said first and second pivoting guides are configured as guide slots or guide cutouts.

21. The device as claimed in claim 20, wherein the corresponding first and second pivoting guides of adjacent securing parts are formed on opposite sides of said anchoring part and of said actuating element of said base body.

22. The device as claimed in claim 15, wherein said actuating element causes said securing part to be in the removal position by falling on account of the force of gravity and is configured to be raised in order to cause said securing part to be in the locking position and said actuating element is configured to be fixed and locked such that said securing part is configured to be fixed and locked in both the removal and locking positions.

23. The device as claimed in claim 22, wherein the movement of said actuating element and of said securing part is elastically damped.

24. The device as claimed in claim 15, wherein said actuating element comprises a spring.

25. The device as claimed in claim 15, wherein said actuating element comprises an electric motor.

26. The device as claimed in claim 15, wherein said actuating element comprises a drive arranged in or on said base body.

27. The device as claimed in claim 26, wherein said drive has an internal power supply in the form of a rechargeable battery.

28. The device as claimed in claim 1, wherein said securing part is configured to be locked in the locking position.

29. The device as claimed in claim 28, wherein said base body comprises an anchoring part and an actuating element, and a relative movement between said anchoring part and said actuating element is prevented for the purpose of locking said securing part in the locking position.

30. The device as claimed in claim 28, further comprising a locking bolt, said locking bolt being structured to lock said securing part in the locking position, said locking bolt acting on or in said actuating element from outside said base body.

31. The device as claimed in claim 30, wherein said locking bolt is a component part of mechanical or electrical or electromagnetic lock.

32. The device as claimed in claim 30, wherein said locking bolt is arranged in said base body.

33. The device as claimed in claim 26, wherein said drive can be actuated remotely.

34. The device as claimed in claim 33, wherein the device comprises at least one RF transmitter and said actuating element comprises at least one RF receiver and wherein remote actuation is effected by RF signals.

35. The device as claimed in claim 15, wherein the position of said actuating element is configured to be detected and said base body is assigned a battery-operated or battery-buffered acoustic or optical indication which indicates the locking position or the removal position of said securing part depending on the position of said actuating element.

36. The device as claimed in claim 15, wherein the position of said actuating element is configured to be detected and said base body is assigned a battery-operated or battery-buffered alarm system which is configured to be triggered depending on the position of said actuating element.

37. The device as claimed in claim 1, wherein said base body is configured to be placed onto the floor or onto a table.

38. The device as claimed in claim 1, wherein said base body is configured to be suspended from the ceiling or mounted on the wall.

39. The device as claimed in claim 1, wherein said base body comprises a light source and at least one light outlet.

* * * * *